US008058957B2

(12) United States Patent
Irion, II et al.

(10) Patent No.: US 8,058,957 B2
(45) Date of Patent: Nov. 15, 2011

(54) MAGNETIC INTERCONNECTION DEVICE

(75) Inventors: James M. Irion, II, Allen, TX (US); Brian W. Johansen, McKinney, TX (US)

(73) Assignee: Raytheon Company, Waltham, MA (US)

( * ) Notice: Subject to any disclaimer, the term of this patent is extended or adjusted under 35 U.S.C. 154(b) by 262 days.

(21) Appl. No.: 12/489,015

(22) Filed: Jun. 22, 2009

(65) Prior Publication Data

US 2009/0317985 A1 Dec. 24, 2009

Related U.S. Application Data

(60) Provisional application No. 61/132,872, filed on Jun. 23, 2008, provisional application No. 61/132,849, filed on Jun. 23, 2008.

(51) Int. Cl.
*H01P 1/10* (2006.01)
*H01H 53/04* (2006.01)

(52) U.S. Cl. ..... 333/262; 335/4

(58) Field of Classification Search ..... 333/262, 333/101, 105, 25; 335/4
See application file for complete search history.

(56) References Cited

U.S. PATENT DOCUMENTS

| | | | | |
|---|---|---|---|---|
| 4,123,730 | A | 10/1978 | Fikart | |
| 4,173,019 | A | 10/1979 | Williams | |
| 4,903,340 | A | 2/1990 | Sorensen | |
| 6,016,092 | A * | 1/2000 | Qiu et al. | 333/262 |
| 6,674,340 | B2 * | 1/2004 | Quan et al. | 333/164 |
| 6,800,503 | B2 * | 10/2004 | Kocis et al. | 438/52 |
| 6,850,203 | B1 | 2/2005 | Schuneman et al. | |
| 6,867,742 | B1 | 3/2005 | Irion, II et al. | |
| 7,138,952 | B2 | 11/2006 | McGrath et al. | |
| 7,264,479 | B1 | 9/2007 | Lee | |
| 7,274,328 | B2 | 9/2007 | McIntire et al. | |
| 7,354,315 | B2 | 4/2008 | Goetz et al. | |
| 7,372,349 | B2 * | 5/2008 | Wheeler et al. | 335/78 |
| 7,500,882 | B2 | 3/2009 | Goetz et al. | |
| 2004/0080455 | A1 | 4/2004 | Lee | |
| 2006/0038732 | A1 | 2/2006 | Deluca et al. | |
| 2007/0018762 | A1 | 1/2007 | Wheeler et al. | |
| 2009/0073075 | A1 | 3/2009 | Irion, II | |

* cited by examiner

*Primary Examiner* — Dean O Takaoka
(74) *Attorney, Agent, or Firm* — Baker Botts L.L.P.

(57) ABSTRACT

According to one embodiment, a first magnetic coupling element is coupled to a first conductive element of a first electrical circuit. A second magnetic coupling element is coupled to a second conductive element of a second electrical circuit. The second magnetic coupling element is operable to attract the first magnetic coupling element using a magnetic force such that electrical contact is made between the first conductive element and the second conductive element.

22 Claims, 7 Drawing Sheets

| | Aluminum-Nickel-Cobalt (Alnico) | Strontium-Iron (Ferrites/Ceramics) | Neodymium-Iron-Boron (NIB, rare earth) | Samarium-Cobalt (SmCo rare earth) |
|---|---|---|---|---|
| Strength Loss | | | | <1% in 10 years |
| Strength | | | Strongest | Strongest when Temp >300°F |
| Mechanical Properties | Not Brittle | Brittle | Brittle | Brittle |
| Max Operating Temp | < 1004°F (540°C) | < 572°F (300°C) | < 302°F (150°C) | < 572°F (300°C) |
| Curie Temp (all strength lost permanently) | > 1580°F (860°C) | > 860°F (460°C) | > 590°F (310°C) | > 1382°F (750°C) |
| Moisture Resistance | Don't rust or corrode easily | Don't rust or corrode easily | Corrodes easily, best coated with nickel or gold | Don't rust or corrode easily |
| Resist Demagnetizing | Poor | Good, if kept away from rare earth magnets | Best | Good, if kept away from NIB magnets |

*FIG. 7*

| | Aluminum-Nickel-Cobalt (Alnico) | Strontium-Iron (Ferrites/Ceramics) | Neodymium-Iron-Boron (NIB, rare earth) | Samarium-Cobalt (SmCo rare earth) |
|---|---|---|---|---|
| Strength Loss | | | | <1% in 10 years |
| Strength | | | Strongest | Strongest when Temp >300°F |
| Mechanical Properties | Not Brittle | Brittle | Brittle | Brittle |
| Max Operating Temp | < 1004°F (540°C) | < 572°F (300°C) | < 302°F (150°C) | < 572°F (300°C) |
| Curie Temp (all strength lost permanently) | > 1580°F (860°C) | > 860°F (460°C) | > 590°F (310°C) | > 1382°F (750°C) |
| Moisture Resistance | Don't rust or corrode easily | Don't rust or corrode easily | Corrode easily, best coated with nickel or gold | Don't rust or corrode easily |
| Resist Demagnetizing | Poor | Good, if kept away from rare earth magnets | Best | Good, if kept away from NIB magnets |
| Cost | | | Excellent | |
| Hazard | | | Neo dust is combustible, explosive, toxic when burned | |

*FIG. 8*

MAGNETIC INTERCONNECTION DEVICE

RELATED APPLICATIONS

Pursuant to 35 U.S.C. §119(e), this application claims priority to U.S. Provisional Patent Application Ser. No. 61/132,872, entitled MAGNETIC INTERCONNECTION DEVICE, filed Jun. 23, 2008. U.S. Provisional Patent Application Ser. No. 61/132,872 is hereby incorporated by reference.

Pursuant to 35 U.S.C. §119(e), this application claims priority to U.S. Provisional Patent Application Ser. No. 61/132,849, entitled DUAL-POLARIZED ANTENNA ARRAY, filed Jun. 23, 2008. U.S. Provisional Patent Application Ser. No. 61/132,849 is hereby incorporated by reference.

TECHNICAL FIELD OF THE DISCLOSURE

This disclosure generally relates to electrical circuit devices, and more particularly, to a magnetic interconnection for forming electrical interconnections between conductive elements.

BACKGROUND OF THE DISCLOSURE

Electrical circuits may employ a number of electrical components, such as resistors, capacitors, inductors, or integrated circuits to supply a useful function. These electrical components may be implemented on one or more circuit cards or other generally rigid or non-rigid structure. The one or more circuit cards may have conductive traces that interconnect the various nodes of the electrical components. In some cases, electrical circuits may be implemented on multiple circuit cards for various reasons, such as to simplify their manufacturing process or segregate components of the electrical circuit according to its modular building blocks.

SUMMARY OF THE DISCLOSURE

According to one embodiment, a first magnetic coupling element is coupled to a first conductive element of a first electrical circuit. A second magnetic coupling element is coupled to a second conductive element of a second electrical circuit. The second magnetic coupling element is operable to attract the first magnetic coupling element using a magnetic force such that electrical contact is made between the first conductive element and the second conductive element Some embodiments of the present disclosure may provide numerous technical advantages. A technical advantage of one embodiment may be enhanced electrical interconnections between circuits. Another technical advantage of one embodiment may include the ability to provide compact electrical interconnections while being relatively easy to disassemble. Another technical advantage of one embodiment may include the capability to protect electrical interconnections against vibration damage. Another technical advantage of one embodiment may include the capability to lower construction costs and mass-produce circuit components.

Although specific advantages have been disclosed hereinabove, it will be understood that various embodiments may include all, some, or none of the disclosed advantages. Additionally, other technical advantages not specifically cited may become apparent to one of ordinary skill in the art following review of the ensuing drawings and their associated detailed description.

BRIEF DESCRIPTION OF THE DRAWINGS

A more complete understanding of embodiments of the disclosure will be apparent from the detailed description taken in conjunction with the accompanying drawings in which:

FIGS. 7 and 8 show various properties of several types of magnets that may be used with an electrical interconnection device.

DETAILED DESCRIPTION OF EXAMPLE EMBODIMENTS

It should be understood at the outset that, although example implementations of embodiments of the invention are illustrated below, the present invention may be implemented using any number of techniques, whether currently known or not. The present invention should in no way be limited to the example implementations, drawings, and techniques illustrated below. Additionally, the drawings are not necessarily drawn to scale.

Known circuit interconnection mechanisms, such as electrical connectors or solder connections, may create problems in certain implementations. Electrical connectors typically incorporate a relatively bulky physical structure that may hinder its use in physically small applications. Furthermore, in applications having numerous interconnection paths, electrical connectors having many contacts may be difficult to manage due to the relatively large amount of insertion force required. Soldered connections, on the other hand, may be relatively difficult to disassemble and may be prone to damage due to vibration. Accordingly, teachings of certain embodiments recognize that magnetic interconnection devices may provide an alternative technique for electrical interconnection of circuit cards or other structures. For example, teachings of certain embodiments recognize that electrical interconnection devices may be incorporated into a variety of circuits, such as stripline, microstrip, coplaner waveguide, digital, DC, and any other suitable circuits.

Teachings of certain embodiments further recognize that magnetic interconnection devices may be incorporated into an antenna or an antenna array. As a non-limiting example, magnetic interconnection devices may be incorporated into an antenna array such as the antenna array of U.S. application entitled "Dual-Polarized Antenna Array", which is being filed concurrently, for Ser. No. 12/489,130. Teachings of certain embodiments recognize that the ability to disassemble magnetic interconnects may be especially beneficial in the context of antennas and antenna arrays.

Figure 1A:
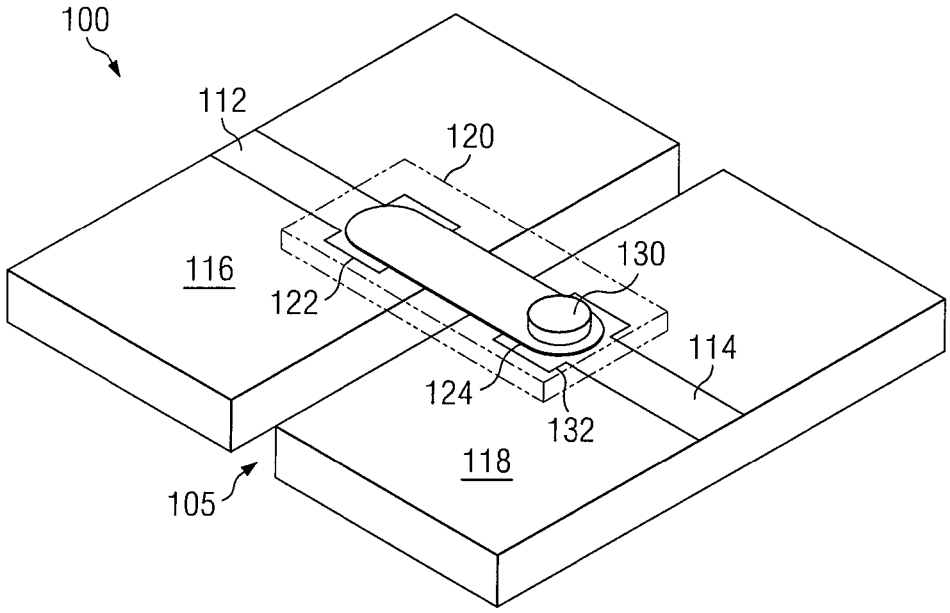
FIGS. 1A and 1B show one embodiment of an electrical interconnection device according to the teachings of the present disclosure.
Figure 1B:
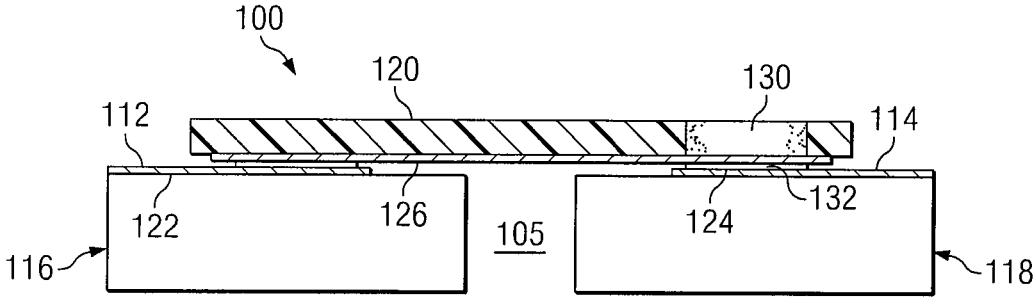

FIGS. 1A and 1B show an electrical interconnection device 100 according to one embodiment. This example features a first conductive element 112 and a second conductive element 114. The first conductive element 114 is coupled with a first substrate 116, and the second conductive element 114 is coupled with a second substrate 118. In the illustrated embodiment, the first and second substrates 116 and 118 are separated by a slot 105. A third substrate 120 spans the slot 105 and couples to the first and second substrates 116 and 118 at points 122 and 124, respectively. A third conductive element 126 is coupled to the third substrate 120.

The first, second, and third substrates 116, 118, and 120 may be comprised of any suitable material. Embodiments of the first, second, and third substrates 116, 118, and 120 may include both rigid and flexible materials. In one embodiment, one or more of the substrates 112, 114, and 120 may be comprised of a flexible circuit substrate. In another embodiment, the substrates 112, 114, and 120 may be comprised of a circuit board material. The first, second, and third conductive elements 112, 114, and 126 may also be comprised of any suitable material. For example, in one embodiment, one or more of the elements 112, 114, and 122 may include a relatively thin strip of copper. In some embodiments, the elements 112, 114, and 122 may be integrally formed with the substrates 112, 114, and 120.

The third conductive element 126 may couple to first and second conductive elements 112 and 114 according to any suitable mechanism. For example, the embodiment of FIGS. 1A and 1B illustrates two available mechanisms. In this example, the third conductive element 126 is soldered to the first conductive element 112 at the point 122. The third conductive element 126 attaches to the second conductive element 114 at the point 124 using a magnet 130 and a magnetic coupler 132. The magnet 130 is coupled to the third substrate 130, and the magnetic coupler 132 is coupled to the second substrate 118. When the magnet 130 is placed in close proximity to the magnetic coupler 132, a magnetic attractive force is developed that causes the third conductive element 120 to contact the second conductive element 114. Thus, in this example, an electrical interconnection between the first and second conductive elements 112 and 114 may be established through the third conductive element 126.

Figure 2A:
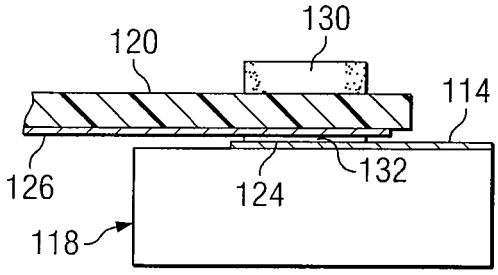
FIGS. 2A and 2B show alternative configurations of the electrical interconnection device of FIGS. 1A and 1B.
Figure 2B:
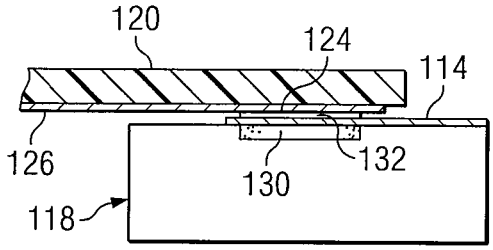

The magnet 130 and the magnetic coupler 132 may be configured in any suitable arrangement. For example, in FIG. 1B, the magnet 130 is embedded into the third substrate 120. FIGS. 2A and 2B show two additional examples of magnetic coupling arrangements. In FIG. 2A, the magnet 130 is mounted on the surface of the third substrate 120. In FIG. 2B, magnet 130 is embedded into the second substrate 114. Embodiments of the magnet 130 and the magnetic coupler 132 may be incorporated into one, some, or all of the first substrate 116, the second substrate 118, and the third substrate 120.

In some embodiments, the magnet 130 and/or the magnetic coupler 132 may be electrically coupled to the third conductive element 126 and the second conductive element 114, respectively. In these embodiments, the magnet 130 and/or the magnetic coupler 132 may be incorporated into the circuit that completes the connection between the third conductive element 126 and the second conductive element 114. In other embodiments, the magnet 130 and/or the magnetic coupler 132 may attract the third conductive element 126 to the second conductive element 114 without being incorporated into the circuit that completes the connection between elements 114 and 126.

The magnet 130 and the magnetic coupler 132 may be coupled to their respective conductive elements and/or substrates using any suitable approach, such as with conductive epoxy. In some embodiments, the magnet 130 has a surface that is oriented towards the magnetic coupler 132 when mated together. In some embodiments, the surface of the magnet 130 may be implemented with a layer of conductive material, such as gold, to improve electrical contact between the first conductive element 112 and the second conductive element 118.

Figure 3A:
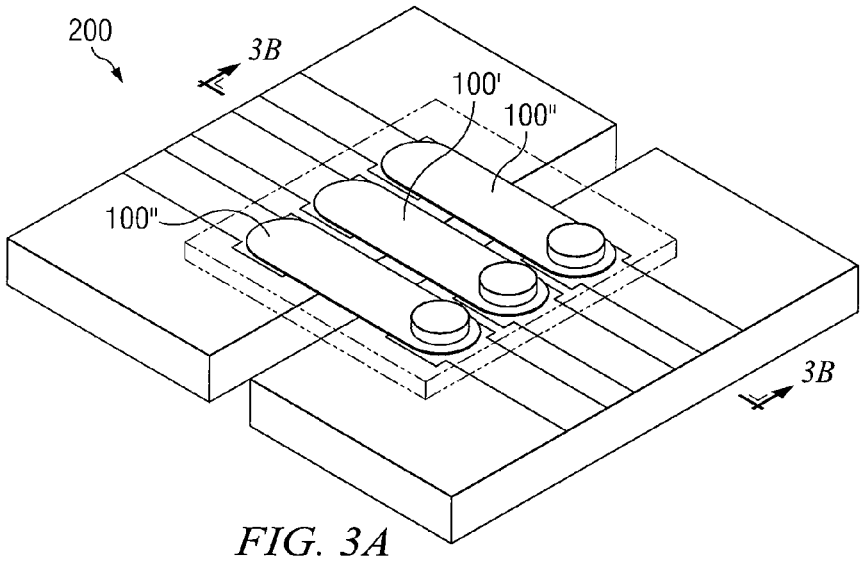
FIGS. 3A and 3B show isometric and crosssection views, respectively, of an electrical interconnection device according to another embodiment.
Figure 3B:
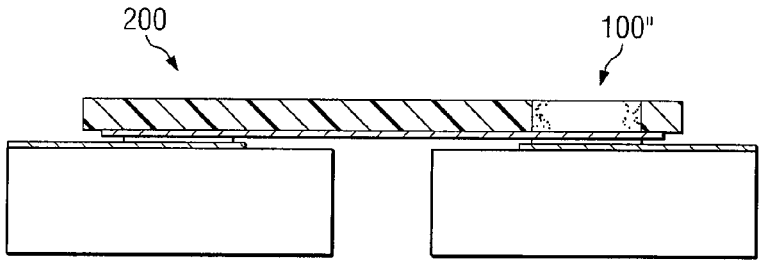

FIGS. 3A and 3B show isometric and crosssection views, respectively, of an electrical interconnection device 200 according to one embodiment. The crosssection view of FIG. 3B shown from the perspective of axis A of FIG. 3A.

In this example, the electrical interconnection device 200 incorporates multiple electrical interconnection devices 100. In this particular embodiment, the electrical interconnection device 200 incorporates three interconnection devices 100. The center interconnection device is shown as 100', and the outside interconnection devices are shown as 100". Teachings of certain embodiments recognize that additional circuits may enable the electrical interconnection device 200 to operate as part of a coplaner waveguide. Teachings of certain embodiments also recognize that multiple electrical interconnection devices 100 may be incorporated in scenarios where additional grounding is needed to span a bridge distance.

Figure 3C:
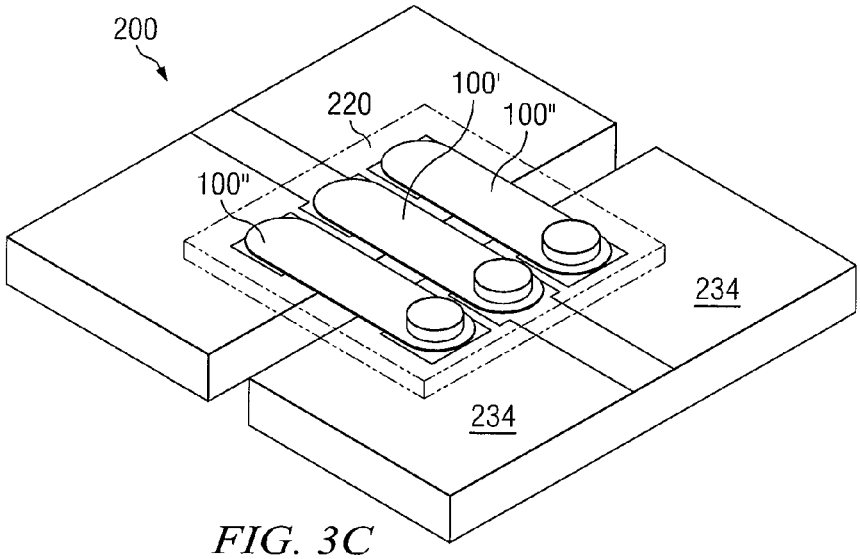
FIG. 3C shows an alternative embodiment of the electrical interconnection device of FIGS. 3A and 3B.

FIG. 3C shows an alternative embodiment of the electrical interconnection device 200 in which the two outer electrical interconnection devices 100" couple ground planes 234 on either side of a conductive element 220. In this embodiment, one example of the conductive element 220 may include the third conductive element 120 of FIG. 1A-1B.

Figure 4A:
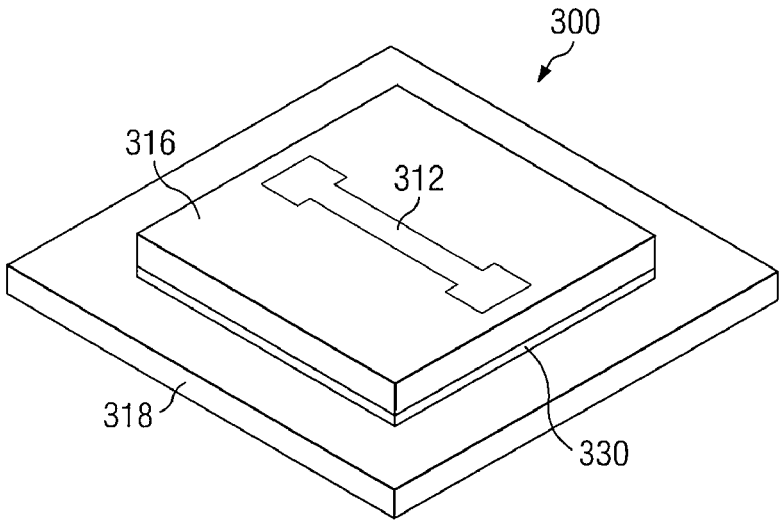
FIGS. 4A and 4B show isometric and crosssection views, respectively, of an electrical interconnection device according to another embodiment.
Figure 4B:
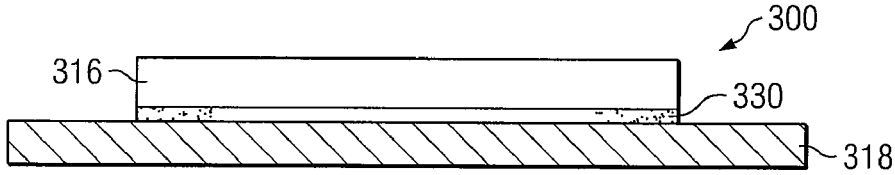

FIGS. 4A and 4B show isometric and side views, respectively, of an electronic interconnect device 300 according to one embodiment. This example features a first substrate 116 and a second substrate 118. In the example embodiment, the first substrate 116 and the second substrate 118 are shown as a circuit card and a carrier plate, respectively. Teachings of certain embodiments recognize that a circuit card may be attached to a carrier plate using a magnetic interface along ground plane surfaces. Teachings of certain embodiments recognize the capability to attach and remove an entire circuit from a carrier, as well as use magnetic interconnects to from connections between adjacent cards. However, embodiments are not limited to the example circuit card and carrier plate configuration.

In this example, the first substrate 316 is coupled to a magnetic layer 330. The magnetic layer 330 provides for releasable attachment to the second substrate 318. In this example embodiment, the carrier plate may be made of a ferromagnetic material. The first substrate 316 may have one or more conductive elements 312, such as copper traces, resistors, capacitors, integrated circuits, or the like, that may be electrically coupled to contact surfaces (not shown) that make electrical contact with complimentary contact surfaces configured on the second substrate 318.

Figure 4C:
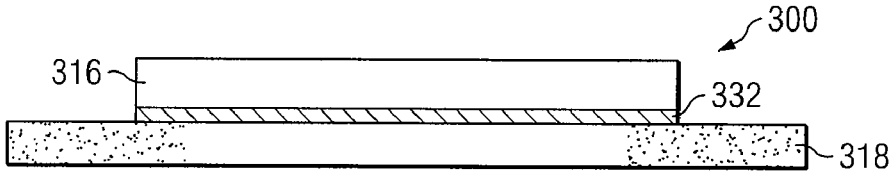
FIG. 4C shows an alternative embodiment of the electrical interconnection device of FIGS. 4A and 4B.

FIG. 4C shows an alternative embodiment of the electrical interconnection device 300 in which the first substrate 316 is attached to a ferromagnetic layer 332. In this example, the second substrate 318 is made of a magnetic material.

Teachings of certain embodiments recognize that magnetic interconnect devices and electrical elements may be incorporated in a variety of antenna circuits, such as stripline, microstrip, coplaner waveguide, digital, DC, and any other suitable circuits. Although only a few example embodiments are shown, antenna configurations are not limited to the illustrative embodiments shown.

Figure 5A:
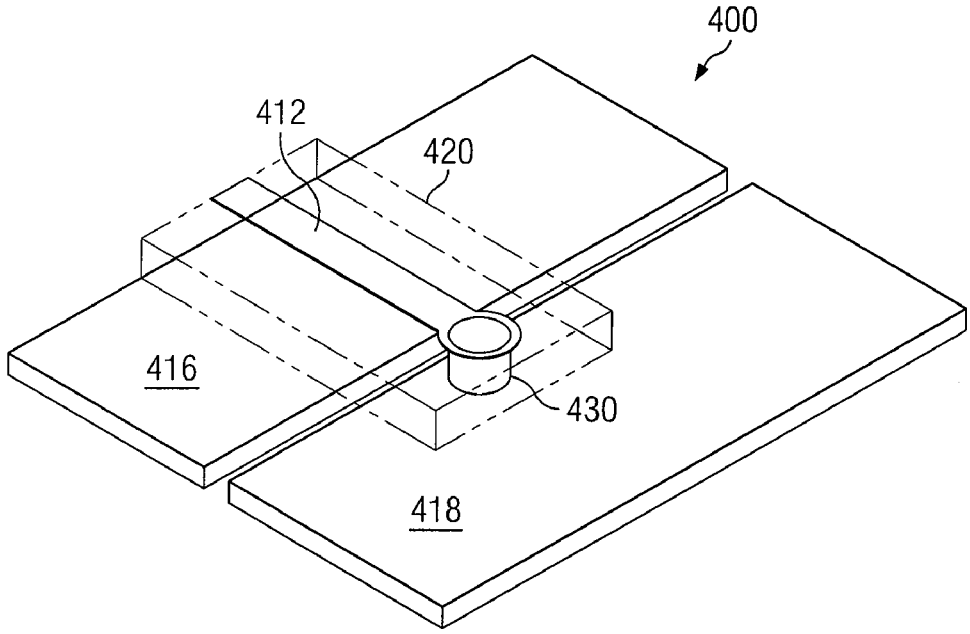
FIGS. 5A and 5B show an electrical interconnection device according to another embodiment.
Figure 5B:
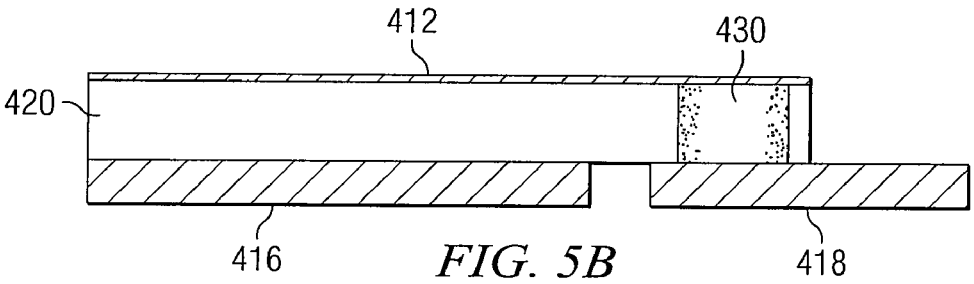
Figure 5C:
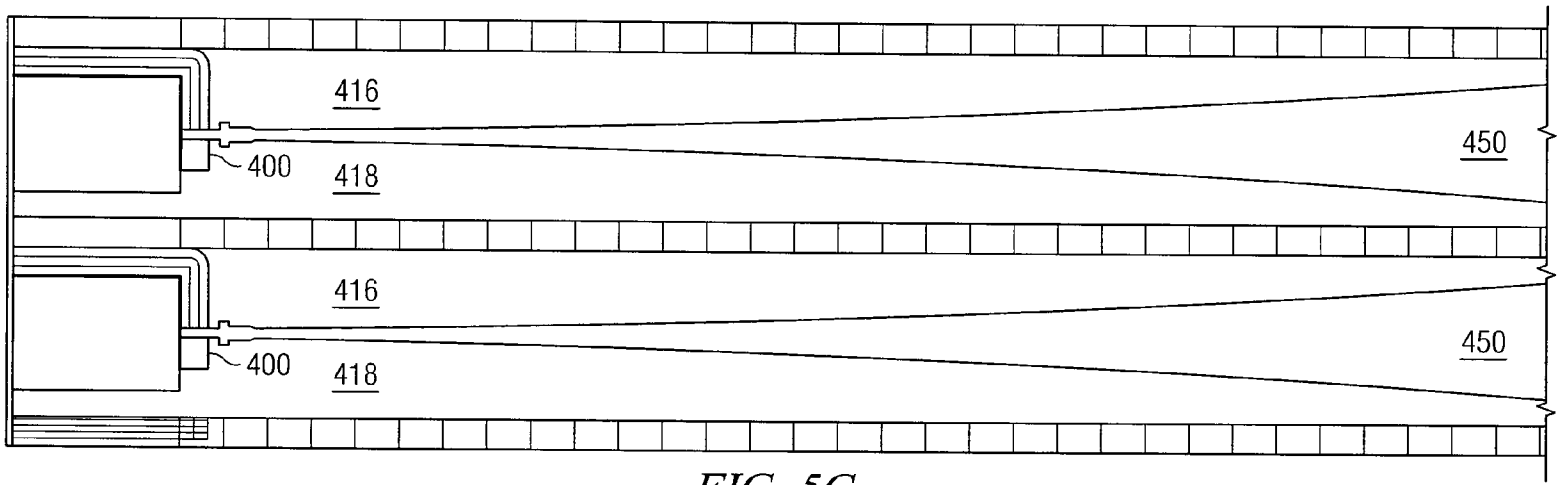
FIG. 5C shows an alternative embodiment of the electrical interconnection device of FIGS. 5A and 5B.

FIGS. 5A, 5B, and 5C provide one illustrative example of a magnetic interconnect device that may be incorporated into an antenna. FIGS. 5A and 5B show an electrical interconnection device 400 according to one embodiment. FIG. 5C shows one embodiment of the electrical interconnection device 400 incorporated into a slotline radiator.

The example embodiment features a first substrate 416, a second substrate 418, and a third substrate 420. In one embodiment, the third substrate 420 may be coupled to an unbalanced line 412 that may be configured as part of a balun for coupling with a balanced slotline radiator 450. In this example, the unbalanced line 412 maybe coupled to a magnet 430. One illustrative example of an unbalanced line 412 may include a t-line connector.

The first and second substrates 416 and 418 may represent one of two radiating elements of the slotline radiator 450. Each of the two substrates 416 and 418 may be made of a ferromagnetic material such that the third substrate 420 makes electrical contact with the second substrate 418 when placed in close proximity. Teachings of certain embodiments recognize that, because the third substrate 420 may extend across the slot between the first and second substrates 416 and 418, a balun may be formed for converting an unbalanced line to a balanced line for transmission or reception of electromagnetic radiation from the slotline radiator 450.

Other example antenna embodiments are recognized. As another non-limiting example, magnetic interconnection devices may be incorporated into an antenna array such as the antenna array of U.S. application entitled "Dual-Polarized Antenna Array", which is being filed concurrently, for Ser. No. 12/489,130. Teachings of certain embodiments recognize that the ability to disassemble magnetic interconnects may be especially beneficial in the context of antennas and antenna arrays.

Figure 6B:
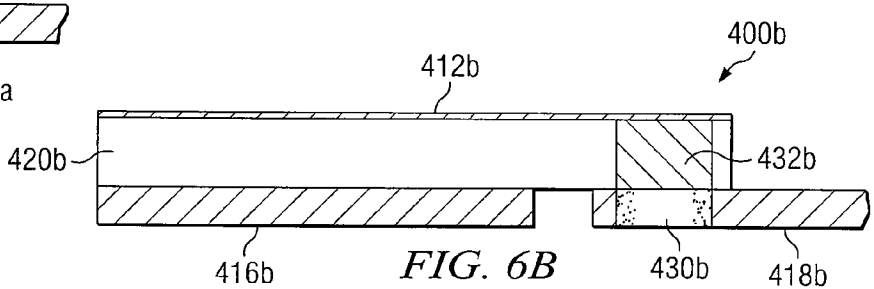
FIGS. 6A and 6B show alternative embodiments of the electrical interconnection device of FIGS. 5A and 5B.
Figure 6A:
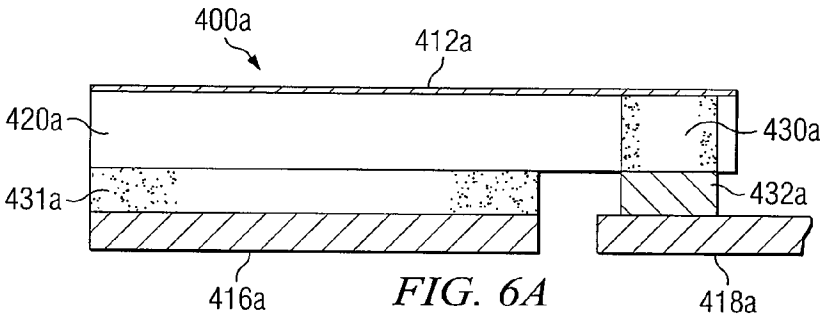

Magnetic coupling may be configured according to any suitable arrangement. For example, in FIG. 5B, the magnet 430 is embedded into the third substrate 420, and the second substrate 418 is made from a ferromagnetic material. FIGS. 6A and 6B show two additional example configurations of magnetic coupling arrangements.

FIG. 6A shows an alternative embodiment of a electrical interconnection device 400*a*. The example embodiment features a first substrate 416*a*, a second substrate 418*a*, and a third substrate 420*a*. The third substrate 420*a* may be coupled to a conducting element 412*a*.

In this example, a magnet 430*a* may be embedded in the third substrate 420*a*. In some embodiments, the magnet 430*a* may be electrically coupled to the conducting element 412*a*. This example also features a magnet layer 431*a*, which may coupled to the first substrate 416*a* and/or the third substrate 420*a*. In one example, the first substrate 416*a* is made from a ferromagnetic material, and the magnetic layer 431*a* is coupled to the third substrate 420*a* and magnetically coupled to the first substrate 416*a*. This example also features a magnetic coupler 432*a*, which may be coupled to the second substrate 418*a* and/or the third substrate 420*a*. In one example, the magnetic coupler 432*a* is coupled to the second substrate 418*a* and magnetically coupled to the magnet 430*a* embedded in the third substrate 420*a*. In some embodiments, the second substrate 418*a* may also be made of a ferromagnetic material.

FIG. 6B shows an alternative embodiment of a electrical interconnection device 400*b*. The example embodiment features a first substrate 416*b*, a second substrate 418*b*, and a third substrate 420*b*. The third substrate 420*b* may be coupled to a conducting element 412*b*.

In this example, a magnet 430*b* may be embedded in the second substrate 418*b*, and a magnetic coupler 432*b* may be embedded in the third substrate 420*b*. In some embodiments, the magnetic coupler 432*b* may be electrically coupled to the conducting element 412*b*. In some embodiments, the second substrate 418*b* may also be made of a ferromagnetic material. In some embodiments, the first substrate 416*b* and the third substrate 420*b* may also be magnetically coupled.

Teachings of certain embodiments recognize the use of magnetic and ferromagnetic material in magnetic interconnection devices. Magnetic and ferromagnetic materials may be any shape and/or size and may include any suitable materials. FIGS. 7 and 8 show non-limiting examples of several magnetic and/or ferromagnetic materials that may be incorporated into an electrical interconnection device. Magnets made of aluminum-nickel-cobalt (alinco), strontium-iron, neodymium-iron-boron (rare Earth), and samarium-cobalt (SmCo) are shown; however, any suitable type of magnet may be implemented with the teachings of the present disclosure. Ferromagnetic materials may include any suitable materials that exhibit an attractive force under the influence of a magnetic field, such as iron or nickel.

Modifications, additions, or omissions may be made to the systems and apparatuses described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

To aid the Patent Office, and any readers of any patent issued on this application in interpreting the claims appended hereto, applicants wish to note that they do not intend any of the appended claims to invoke 6 of 35 U.S.C. §112 as it exists on the date of filing hereof unless the words "means for" or "step for" are explicitly used in the particular claim.

What is claimed is:

1. An apparatus, comprising:

a first substrate;

a first conductive element coupled to the first substrate, wherein the first conductive element is in electrical contact with an antenna feed circuit;

a first magnetic coupling element coupled to the first substrate;

a second substrate separate from the first substrate and being approximately parallel with the first substrate, wherein the first substrate and the second substrate are separated by a slot portion;

a second conductive element coupled to the second substrate, wherein the second substrate is in electrical contact with an antenna radiator circuit;

a third substrate coupled to the second substrate and extending generally across the slot portion towards the first substrate; and a third conductive element coupled to the connector substrate and in electrical contact with the second conductive element; and a second magnetic coupling element coupled to the third substrate, the second magnetic coupling element operable to attract the first magnetic coupling element using a magnetic force such that electrical contact is made between the first conductive element and the third conductive element, wherein:

the first conductive element and the second conductive element are separated by the slot portion, the apparatus further comprising an elongated conductive element, the elongated conductive element operable to traverse the slot portion and operable to carry an electrical signal between the antenna feed circuit and the antenna radiator circuit.

2. An apparatus comprising:

a first substrate;

a first conductive element coupled to the first substrate, wherein the first conductive element is associated with a first electrical circuit;

a first magnetic coupling element coupled to the first substrate;

a second substrate separate from the first substrate;

a second conductive element coupled to the second substrate, wherein the second substrate is associated with a second electrical circuit;

a third substrate coupled to the second substrate and extending towards the first substrate; and a third conductive element coupled to the connector substrate and in electrical contact with the second conductive element; and a second magnetic coupling element coupled to the third substrate, the second magnetic coupling element operable to attract the first magnetic coupling element using a magnetic force such that electrical contact is made between the first conductive element and the third conductive element.

3. The apparatus of claim 2, wherein the first magnetic coupling element is formed of a ferromagnetic material.

4. The apparatus of claim 3, wherein the ferromagnetic material is a material that is selected from the group consisting of iron or nickel.

5. The apparatus of claim 2, wherein the second magnetic coupling element is formed of a ferromagnetic material.

6. The apparatus of claim 5, wherein the ferromagnetic material is a material that is selected from the group consisting of iron or nickel.

7. The apparatus of claim 2, wherein the first magnetic coupling element is made of a material that is selected from the group consisting of aluminum-nickel-cobalt, strontium-iron, neodymium-iron-boron, and samarium-cobalt.

8. The apparatus of claim 2, wherein the second magnetic coupling element is made of a material that is selected from the group consisting of aluminum-nickel-cobalt, strontium-iron, neodymium-iron-boron, and samarium-cobalt.

9. The apparatus of claim 2, wherein the first electrical circuit is an antenna feed circuit.

10. The apparatus of claim 2, wherein the second electrical circuit is an antenna radiator circuit.

11. The apparatus of claim 2, wherein:

the first electrical circuit is an unbalanced transmission line, and the second electrical circuit is a balanced radiator circuit.

12. The apparatus of claim 2, wherein the electrical contact made between the first conductive element and the second conductive element forms an antenna circuit.

13. The apparatus of claim 12, wherein the antenna circuit is selected from the group consisting of striplines, microstrips, coplaner waveguides, digital circuits, and DC Circuits.

14. The apparatus of claim 2, wherein the first conductive element and the second conductive element are separated by slot a portion, the third conductive element is an elongated conductive element, the elongated conductive element operable to traverse the slot portion and operable to carry an electrical signal between the first electrical circuit and the second electrical circuit.

15. The apparatus of claim 14, wherein the first electrical circuit, the second electrical circuit, and the slot portion forms a slotline radiator.

16. The apparatus of claim 14, wherein the elongated conductive element is coupled to a flexible circuit substrate.

17. The apparatus of claim 14, wherein the elongated conductive element is coupled to a circuit card.

18. The apparatus of claim 14, wherein the elongated conductive element is a microstrip.

19. The apparatus of claim 14, wherein the elongated conductive element is a stripline circuit.

20. The apparatus of claim 14, wherein the slot portion further includes a balun portion.

21. The apparatus of claim 14, wherein:

the first electrical circuit is an unbalanced transmission line, and the second electrical circuit is a balanced radiator circuit.

22. The apparatus of claim 2, wherein the first conductive element is associated with a first antenna radiator, the second conductive element is associated with a second antenna radiator, and the first and second antenna radiators are arranged such that the first magnetic coupling device faces the second magnetic coupling device.

* * * * *